US006968575B2

(12) United States Patent
Durocher

(10) Patent No.: US 6,968,575 B2
(45) Date of Patent: Nov. 29, 2005

(54) HOCKEY HELMET COMPRISING AN OCCIPITAL ADJUSTMENT MECHANISM

(75) Inventor: Jacques Durocher, St-Jérôme (CA)

(73) Assignee: Bauer NIKE Hockey Inc., Saint-Jérôme (CA)

( * ) Notice: Subject to any disclaimer, the term of this patent is extended or adjusted under 35 U.S.C. 154(b) by 105 days.

(21) Appl. No.: 10/705,838

(22) Filed: Nov. 13, 2003

(65) Prior Publication Data

US 2005/0034222 A1 Feb. 17, 2005

(51) Int. Cl.[7] ..... A63B 71/10
(52) U.S. Cl. ..... 2/425; 2/418; 2/421
(58) Field of Search ..... 2/421, 425, 417, 2/418, 419, 420, 414, 415

(56) References Cited

U.S. PATENT DOCUMENTS

| | | | | |
|---|---|---|---|---|
| 3,028,602 | A * | 4/1962 | Miller | 2/6.1 |
| 3,991,423 | A * | 11/1976 | Jones | 2/415 |
| 4,477,929 | A | 10/1984 | Mattsson | |
| 4,713,844 | A | 12/1987 | Westgate | |
| 5,042,093 | A * | 8/1991 | Legendre | 2/149 |
| 5,315,718 | A * | 5/1994 | Barson et al. | 2/418 |
| 5,381,560 | A | 1/1995 | Halstead | |
| 5,511,250 | A * | 4/1996 | Field et al. | 2/418 |
| 5,581,819 | A | 12/1996 | Garneau | |
| 5,584,073 | A | 12/1996 | Radzelovage et al. | |
| 5,638,551 | A | 6/1997 | Lallemand | |
| 5,659,900 | A | 8/1997 | Arney et al. | |
| 5,815,847 | A * | 10/1998 | Holden, Jr. | 2/418 |
| 5,887,288 | A | 3/1999 | Arney et al. | |
| 5,898,950 | A | 5/1999 | Spyrou et al. | |
| 5,915,537 | A * | 6/1999 | Dallas et al. | 2/410 |
| 5,953,761 | A * | 9/1999 | Jurga et al. | 2/425 |
| 6,108,824 | A * | 8/2000 | Fournier et al. | 2/418 |
| 6,256,798 | B1 | 7/2001 | Egolf et al. | |
| 6,266,827 | B1 | 7/2001 | Lampe et al. | |
| 6,298,497 | B1 | 10/2001 | Chartrand | |
| 6,425,142 | B2 | 7/2002 | Sasaki et al. | |
| 6,854,133 | B2 * | 2/2005 | Lee et al. | 2/421 |
| 6,865,752 | B2 * | 3/2005 | Udelhofen et al. | 2/425 |
| 2003/0135914 | A1 | 7/2003 | Racine et al. | |

FOREIGN PATENT DOCUMENTS

| | | |
|---|---|---|
| DE | 77 29 063 | 12/1977 |
| EP | 11124718 | 5/1999 |

* cited by examiner

*Primary Examiner*—Rodney M. Lindsey

(57) ABSTRACT

A hockey helmet for receiving a head of a wearer, the head having a crown region and an occipital region. The helmet comprises a front portion facing the crown region and an occipital inner pad facing the occipital region of the head. The occipital inner pad is movable between a first position to a second position wherein, in the second position, the occipital inner pad applies pressure upon the occipital region of the head for urging the front portion of the helmet towards the crown region of the head. The helmet may also comprise an actuator for moving the occipital inner pad between the first and second positions.

38 Claims, 9 Drawing Sheets

HOCKEY HELMET COMPRISING AN OCCIPITAL ADJUSTMENT MECHANISM

FIELD OF THE INVENTION

The present invention relates to a hockey helmet having an occipital adjustment mechanism for improving the fit of the helmet on the head of the wearer.

BACKGROUND OF THE INVENTION

German Utility Model GM 77 29 063 issued on Dec. 29, 1977 relates to a protective helmet. The helmet comprises a shell, an insulating layer, a soft lining and inflatable air cushions located between the insulating layer and lining, these air cushions being connected with each other by air tubes. The helmet also comprises a bellows, a check valve and an actuation element.

U.S. Pat. No. 5,898,950 entitled *Protective Helmet* issued to Spyrou et al. on May 4, 1999. This patent relates to a helmet comprising a protective shell and releasable attachment means having a first front strap, a second front strap, attachment members, a rear strap, a first side strap, a second side strap, a rear plate, a first support strap and a second support strap. The rear strap comprises an outer region, a first lower extension and a second lower extension, the lower extensions providing a means for cradling the head of the wearer.

Canadian Patent Application 2,414,872 relates to a hockey helmet having an inflatable bladder for improving the fit of the helmet on the head of the wearer. The inflatable bladder is located adjacent the occipital region of the head and may be inflated by a pump.

Against this background, there is a need in the industry for a helmet that provides a better fitting on the head of the wearer.

SUMMARY OF THE INVENTION

As embodied and broadly described herein, the present invention provides a hockey helmet for receiving a head of a wearer. The head has a crown region and an occipital region. The helmet comprises a front portion facing the crown region of the head and an occipital inner pad facing the occipital region of the head. The occipital inner pad is movable towards the occipital region of the head to apply pressure on the occipital region of the head for urging the front portion of the helmet towards the crown region of the head.

As embodied and broadly described herein, the present invention further provides a hockey helmet for receiving a head of a wearer, the head having a crown region, left and right side regions, a back region and an occipital region. The helmet comprises a front portion facing the crown region of the head; a rear portion facing the left and right side regions, the back region and the occipital region of the head; and an occipital inner pad located between the rear portion of the helmet and the occipital region of the head. The helmet also comprises an actuator capable of moving the occipital inner pad from a first position to a second position wherein, in the second position, the occipital inner pad applies pressure upon the occipital region of the head for urging the front portion of the helmet towards the crown region of the head.

As embodied and broadly described herein, the present invention also provides a hockey helmet for receiving a head of a wearer, the head having a crown region, left and right side regions, a back region and an occipital region. The helmet comprises a front shell facing the crown region of the head and a rear shell facing the left and right side regions, the back region and the occipital region of the head, the rear shell comprising outer and inner surfaces and left and right openings positioned symmetrically about a longitudinal axis of the helmet. The helmet also comprises a rear inner pad facing the back and left and right side regions of the head, the rear inner pad being affixed to the inner surface of the rear shell; an occipital inner pad located between the rear shell and the occipital region of the head; a central member extending along the longitudinal axis of said helmet, the central member comprising an upper part that is hingely connected to the inner surface of the rear shell and a lower part that is attached to the occipital inner pad, the lower part comprising left and right passages positioned symmetrically about the longitudinal axis of the helmet; and left and right straps passing through the respective left and right passages of the lower part and the respective left and right openings of the rear shell, each strap comprising a first end and a second end, each first end being retained in the helmet, each second end being accessible to the wearer such that, when the wearer pulls each second end of the left and right straps, the lower part of the central member is movable from a first position to a second position wherein, in the second position, the occipital inner pad applies pressure upon the occipital region of the head for urging the front shell towards the crown region of the head.

As embodied and broadly described herein, the invention further provides a hockey helmet for receiving a head of a wearer, the head having a crown region and an occipital region, the helmet comprising a front portion facing the crown region and an occipital inner pad facing the occipital region of the head, the occipital inner pad being movable between a first position to a second position wherein, in the first position, the occipital inner pad applies a first pressure upon the occipital region of the head, and in the second position, the occipital inner pad applies a second pressure upon the occipital region of the head, the second pressure being greater than the first pressure.

As embodied and broadly described herein, the invention further provides a hockey helmet for receiving a head of a wearer, the head having a crown region, left and right side regions, a back region and an occipital region, the helmet comprising a front portion facing the crown region of the head; a rear portion facing the left and right side regions, the back region and the occipital region of the head; an occipital inner pad located between the rear portion of the helmet and the occipital region of the head; and an actuator capable of moving the occipital inner pad from a first position to a second position wherein, in the first position, the occipital inner pad applies a first pressure upon the occipital region of the head, and in the second position, the occipital inner pad applies a second pressure upon the occipital region of the head, the second pressure being greater than the first pressure.

As embodied and broadly described herein, the invention also provides a hockey helmet for receiving a head of a wearer, the head having a crown region, left and right side regions, a back region and an occipital region, the helmet comprising a front shell facing the crown region of the head; a rear shell facing the left and right side regions, the back region and the occipital region of the head, the rear shell comprising outer and inner surfaces and left and right openings positioned symmetrically about a longitudinal axis of the helmet; a rear inner pad facing the back and left and right side regions of the head, the rear inner pad being affixed to the inner surface of the rear shell; an occipital inner pad located between the rear shell and the occipital region of the head; a central member extending along the longitudinal axis of the helmet, the central member comprising an upper part that is hingely connected to the inner surface of the rear shell and a lower part that is attached to the occipital inner pad, the lower part comprising left and right passages positioned symmetrically about the longitudinal axis of the helmet; and left and right straps passing through the respective left and right passages of the lower part and the respective left and right openings of the rear shell, each strap comprising a first end and a second end, each first end being retained in the helmet, each second end being accessible to the wearer such that, when the wearer pulls each second end of the left and right straps, the lower part of the central member is movable from a first position to a second position wherein, in the first position, the occipital inner pad applies a first pressure upon the occipital region of the head, and in the second position, the occipital inner pad applies a second pressure upon the occipital region of the head, the second pressure being greater than the first pressure.

As embodied and broadly described herein, the invention further provides a hockey helmet for receiving a head of a wearer. The helmet has an outer shell and an occipital inner pad at least partly contained in the shell. The occipital inner pad is movable with relation to the outer shell towards the occipital region of the head to apply pressure on the occipital region of the head. The helmet also has a strap urging the occipital inner pad towards the occipital region of the head when the wearer pulls the strap.

BRIEF DESCRIPTION OF THE DRAWINGS

A detailed description of the embodiments of the present invention is provided herein below, by way of example only, with reference to the accompanying drawings, in which.

Figure 1:
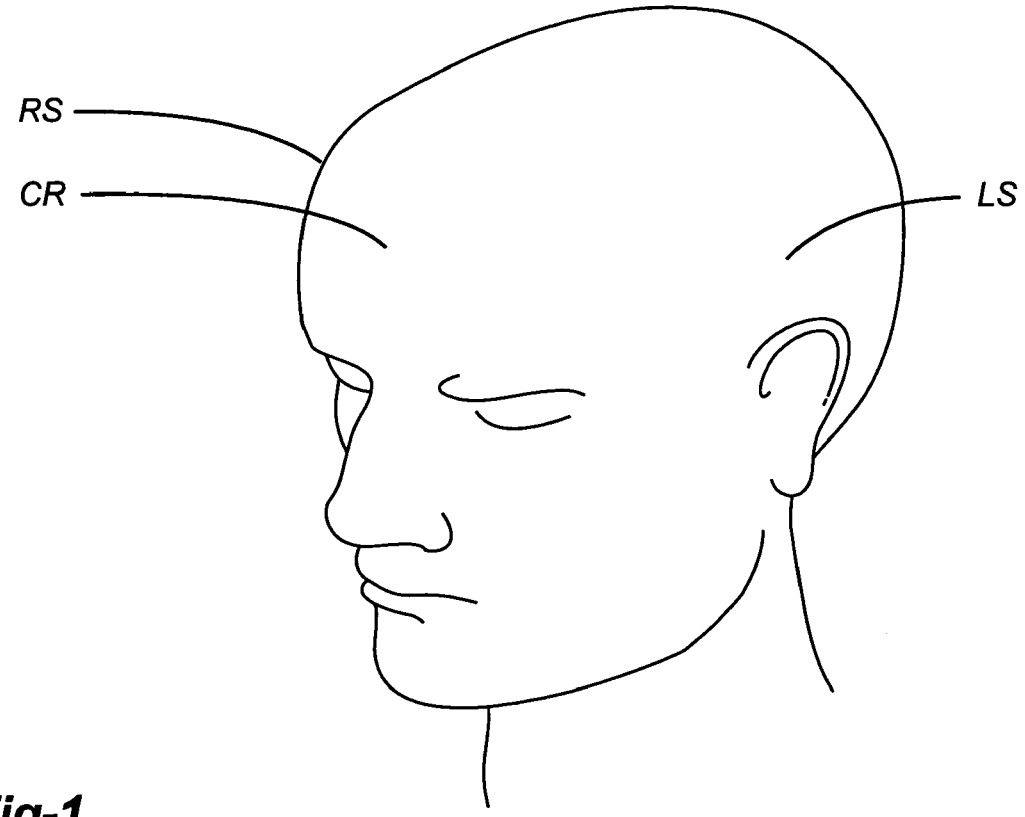
FIG. 1 is a perspective view of a head of a wearer.

In the drawings, embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE EMBODIMENTS OF THE INVENTION

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Figure 2:
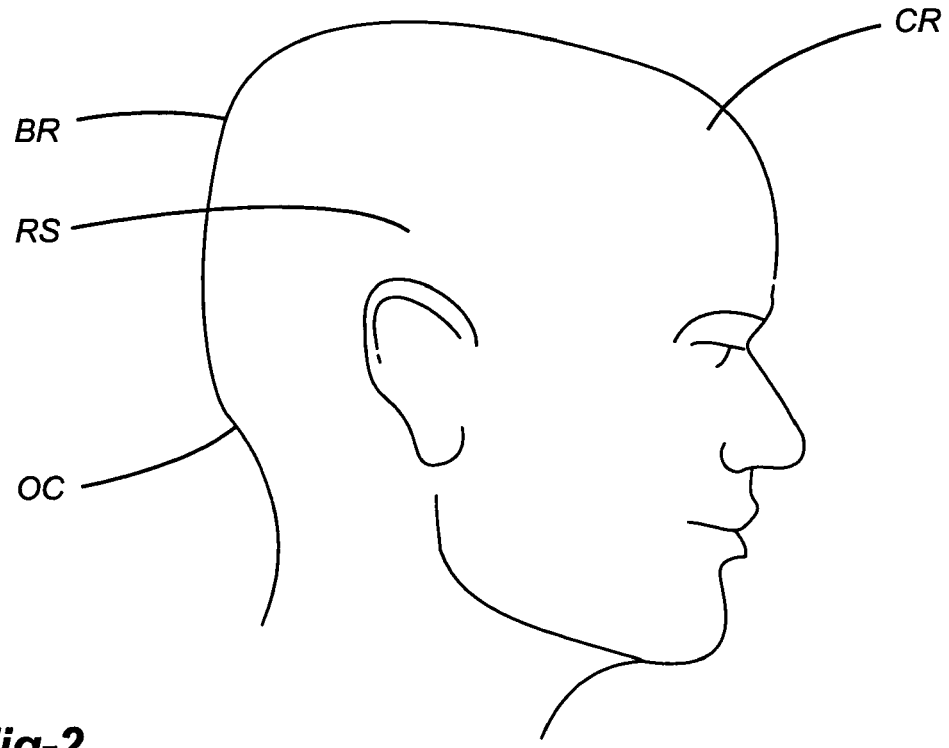
FIG. 2 is a right side elevational view of the head of the wearer of FIG. 1.
Figure 3:
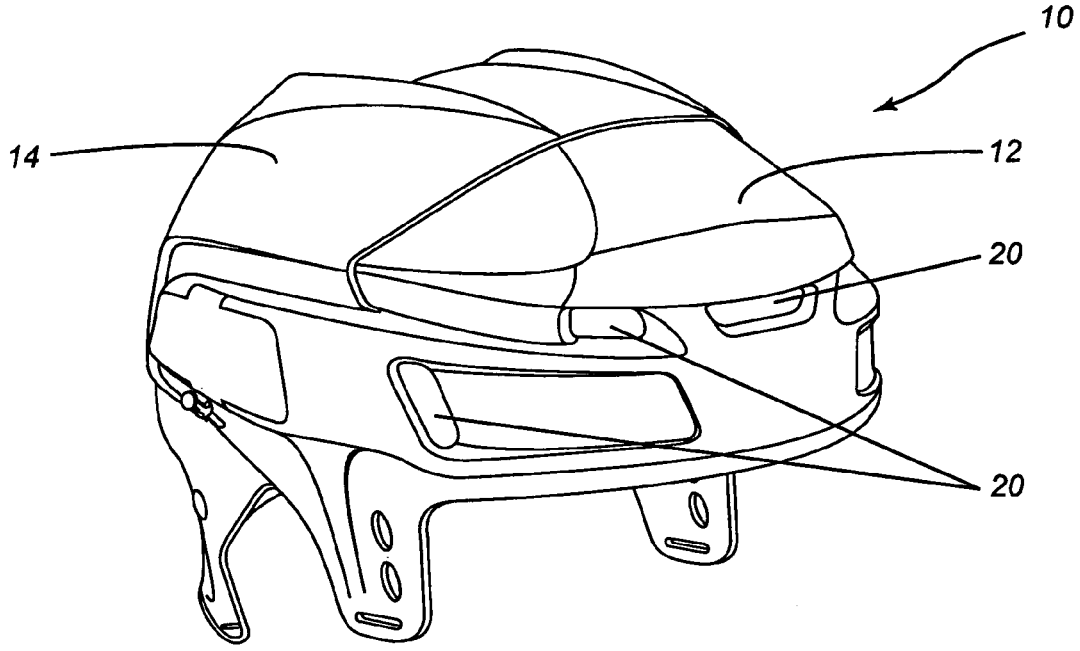
FIG. 3 is a perspective view of a hockey helmet constructed in accordance with an embodiment of the invention.
Figure 4:
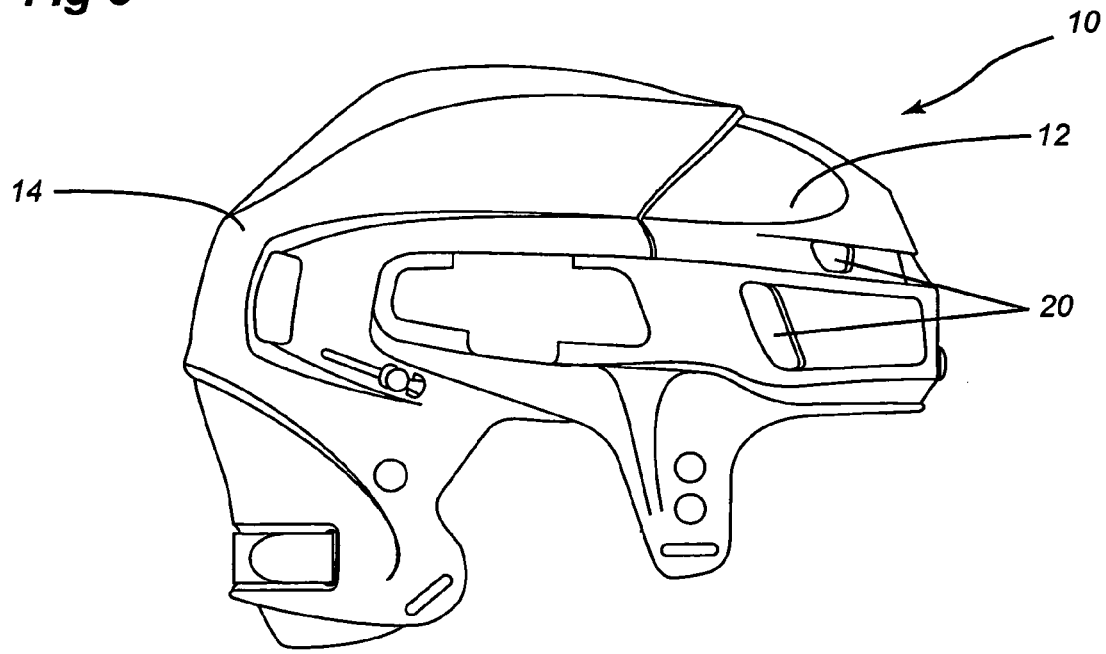
FIG. 4 is a right side elevational view of the hockey helmet of FIG. 3.

FIGS. 1 and 2 illustrate a head of a wearer. The head comprises a crown region CR, left and right side regions LS, RS, a back region BR and an occipital region OC. The crown region CR has a front part that substantially corresponds to the forehead and a top part that substantially corresponds to the front top part of the head. In fact, the crown region CR generally corresponds to the frontal bone region of the head. The left and right side regions LS, RS are approximately located above the ears of the wearer. Occipital region OC substantially corresponds to the region around and under the external occipital protuberance of the head.

Referring to FIGS. 3 to 6, the hockey helmet 10 comprises a front portion 12 and a rear portion 14 interconnected together. Front and rear portions 12, 14 comprise respective front shell 16 and rear shell 18, the rear shell comprising inner and outer surfaces 96, 98. The front shell 16 and rear shell 18 may be made of a relatively rigid material, such as NYLON, polycarbonate materials, thermoplastics, or thermosetting resins or any other suitable material. The front and rear shells 16, 18 includes a plurality of ventilation apertures 20 that provide the added comfort of allowing air to circulate around the head of the wearer.

The front shell 16 overlays front inner pad 22 and top inner pad 30 while the rear shell overlays rear central inner pad 24 and left and right side inner pads 26, 28. The front inner pad 22 faces the front part of the crown region CR while the top inner pad 30 faces the top part of the crown region CR. The central rear inner pad 24 faces the back region BR while the left and right side inner pads 26, 28 face the left and right side regions LS, RS. The inner pads 22, 24, 26, 28 may be made of shock absorbing materials such as expanded polypropylene (EPP) or expanded polyethylene (EPE). Other materials can also be used without departing from the spirit of the invention.

The front inner pad 22 and top inner pad 30 have three-dimensional configurations that match the three-dimensional configurations of the front shell 16 and are attached to the inner surfaces of the front shell 16 by any suitable means such glue, stitches, tacks, staples or rivets. Similarly, rear central inner pad 24 and left and right side inner pads 26, 28 have three-dimensional configurations that match the three-dimensional configurations of the rear shells 18 and are attached to the inner surface 96 of the rear shells 18 by any suitable means, such as glue, stitches, tacks, staples or rivets.

The helmet 10 may also comprise a front comfort liner 32 affixed on the inner surface of the front inner pad 22, a top comfort liner 38 affixed on the inner surface of the top inner pad 30 and left and right side comfort liners 34, 36 affixed on the inner surface of the respective left and right side inner pads 26, 28. The comfort liners 32, 34, 36 and 38 may be made of soft materials such as polyvinyl chloride (PVC). Other materials can also be used without departing from the spirit of the invention. The comfort liners 32, 34, 36 and 38 may be affixed on the inner surface of the respective inner pads 22, 26, 28 and 30 by any suitable means, such as glue, stitches, tacks, staples or rivets.

The hockey helmet 10 may comprise left and right ear loops and a chin strap adapted to be attached to ear loops so that when it is secured beneath the chin of the wearer, the helmet 10 is maintained onto the head of the wearer. If desired, the helmet 10 may be provided with left and right ear covers for protecting the ears of the wearer.

The front and rear portions 12, 14 (front and rear shells 16, 18 more particularly) can move one with relation to the other so as to adjust the size of the head receiving cavity of the helmet 10. Left and right locking mechanisms 50, 52 retain the front and rear portions 12, 14 in the position selected by the wearer. Any suitable type of locking mechanisms such as the one described in U.S. Pat. No. 5,956,776 of Bauer Nike Hockey Inc. issued on Sep. 28, 1999 can be used without departing from the spirit of the invention.

In operation, a wearer who puts on the helmet 10 and realizes that it is too large or too small, does not need to remove the helmet 10 to adjust it. The wearer must simply release the locking mechanism 50, 52 expand or contract the size of the helmet 10 by displacing the front and the rear portion 12, 14 in relation to each other in the appropriate direction.

Alternatively, helmet 10 may comprise a non-adjustable one-piece shell covering a one-piece inner pad and a one-piece comfort liner. In another possible variant, the helmet 10 may comprise separate front and rear portions 12, 14 that are connected to one another in any suitable way but not adjustable one relative to the other.

Figure 12:
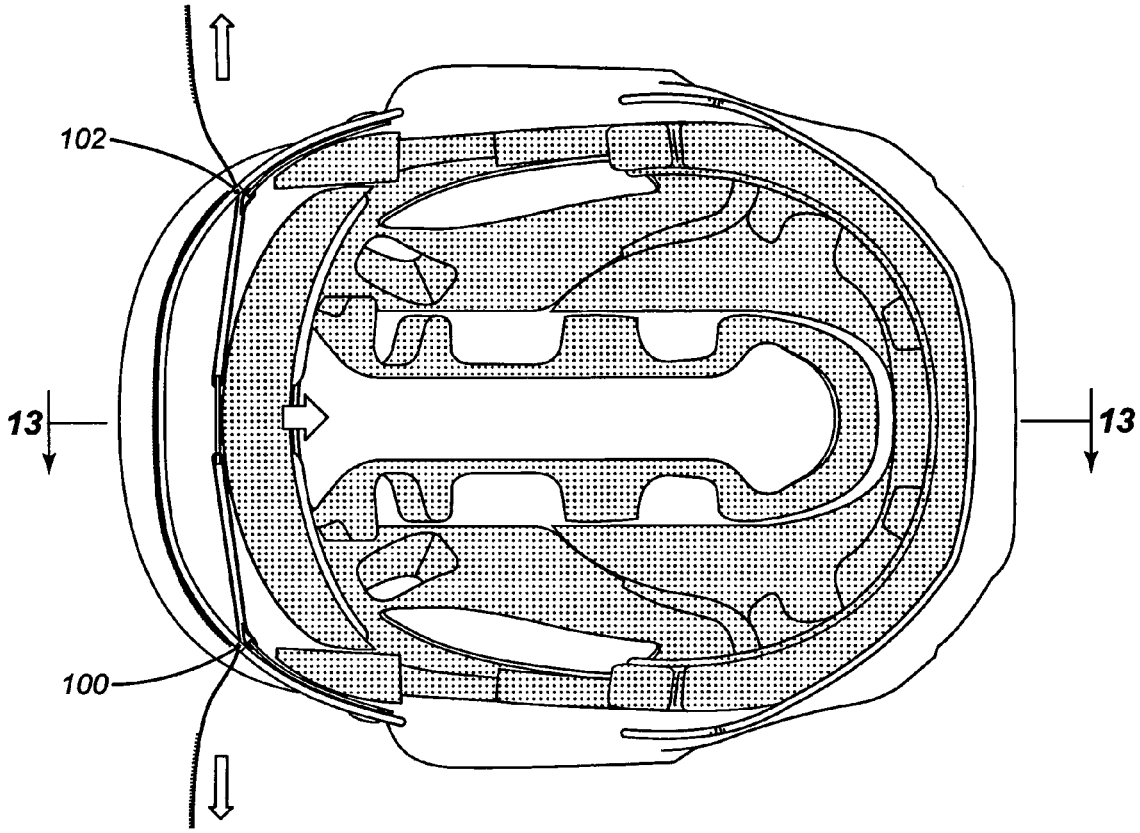
FIG. 12 is a bottom view of the hockey helmet with the occipital inner pad shown in a second position.
Figure 13:
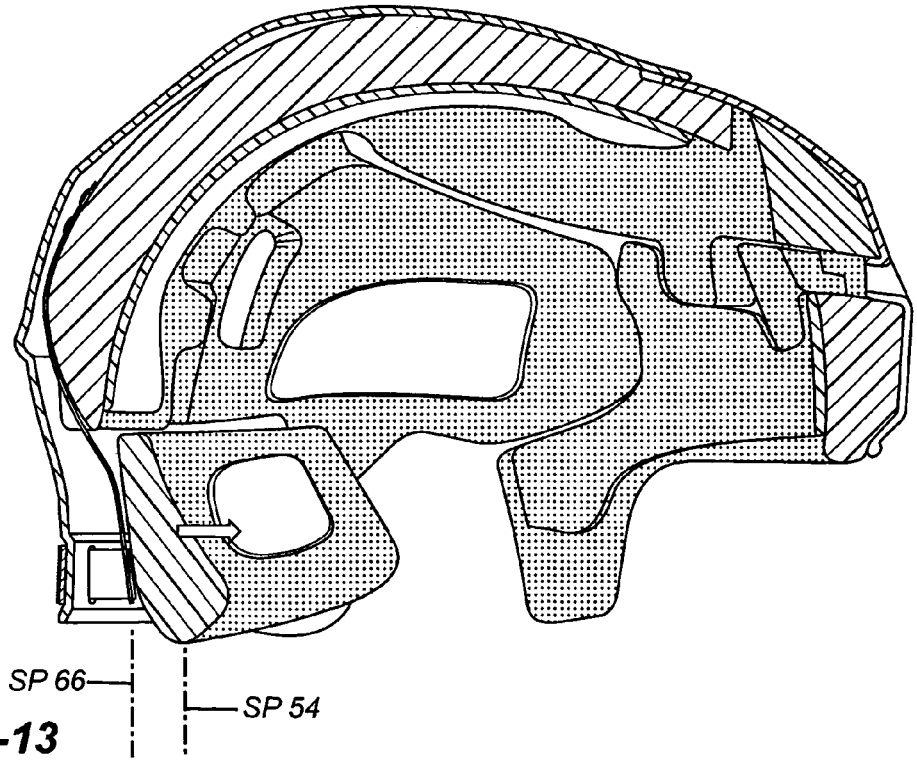
FIG. 13 is a cross-sectional view with the occipital inner pad shown in the second position.

FIGS. 7 to 14 show an occipital adjustment mechanism comprising an occipital inner pad 54 facing the occipital region OC of the head, the occipital inner pad 54 being movable between a first position $FP^{54}$ (see FIGS. 10–11) to a second position $SP^{54}$ (see FIGS. 12–13). In the second position $SP^{54}$, the occipital inner pad 54 applies pressure upon the occipital region OC for urging the front portion 12 (front shell 16, front and top inner pads 22, 30 and front and top comfort liners 32, 38) towards the crown region CR (as previously indicated, the crown region CR has a front part that substantially corresponds to the forehead and a top part that substantially corresponds to the front top part of the head). Depending on how tightly the head of the wearer fits in the head receiving cavity of the helmet 10, the pressure applied by the occipital inner pad 54 induces a corresponding movement of the helmet 10 towards the back of the head, necessary to seat the front portion 12 of the helmet 10 against the crown region CR of the head. Also, depending on how tightly the head of the wearer fits in the head receiving cavity of the helmet, in the first position $FP^{54}$, the occipital inner pad 54 may apply a first pressure upon the occipital region OC of the head, and in the second position $SP^{54}$, the occipital inner pad 54 applies a second pressure upon the occipital region OC of the head, the second pressure being greater than the first pressure.

The occipital inner pad 54 may be made of expanded polypropylene (EPP) or expanded polyethylene (EPE). Other materials can also be used without departing from the spirit of the invention. The occipital inner pad 54 has an inner surface 56 and may comprise left and right occipital comfort liners 58, 60 positioned symmetrically about the longitudinal axis of the helmet 10 on the inner surface 56 (see FIG. 5). The occipital left and right comfort liners 58, 60 may be made of polyvinyl chloride (PVC) but other materials can also be used without departing from the spirit of the invention. The left and right occipital comfort liners 58, 60 may be affixed on the inner surface 56 of the occipital inner pad 54 by any suitable means, such as glue, stitches, tacks, staples or rivets. Alternatively, the occipital inner pad 54 may comprise a one-piece occipital comfort liner on the inner surface 56.

The occipital adjustment mechanism also comprises an actuator capable of moving the occipital inner pad 54 between the first and second positions $FP^{54}$, $SP^{54}$. More particularly, this actuator comprises a central member 62 and left and right straps 72, 74. The left and right straps 72, 74 comprise respective first ends 76, 78 and second ends 80, 82. The second ends 80, 82 comprise respective VELCRO hooks sections 84, 86.

Figure 7:
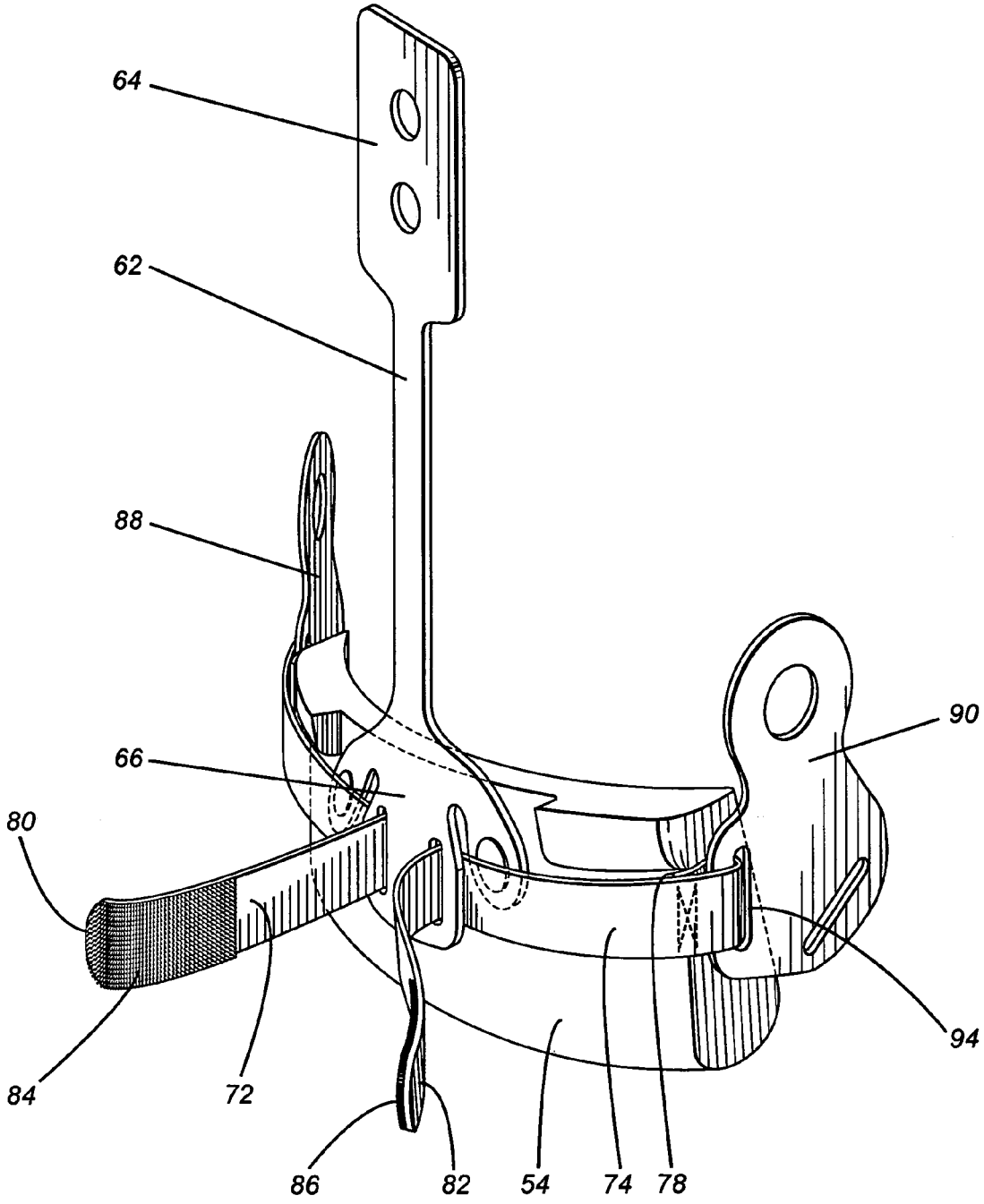
FIG. 7 is a perspective view of an occipital adjustment mechanism for the hockey helmet of FIG. 3.
Figure 8:
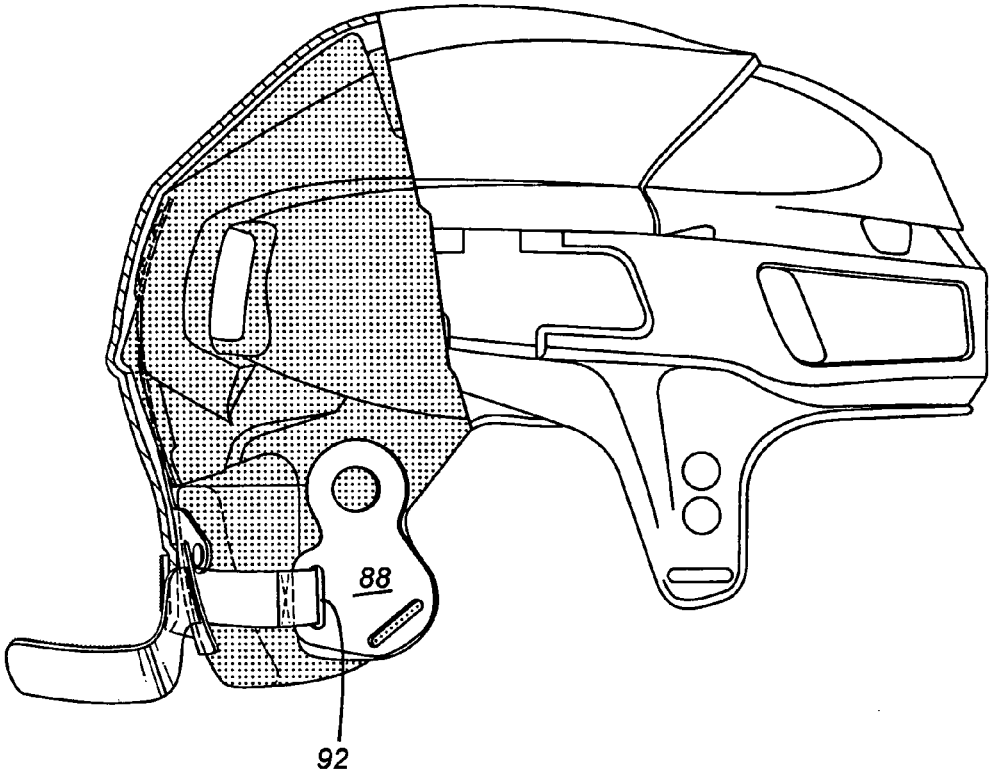
FIG. 8 is a right side elevational view of the hockey helmet of FIG. 3 wherein a portion of the outer shell is cut-away.
Figure 9:
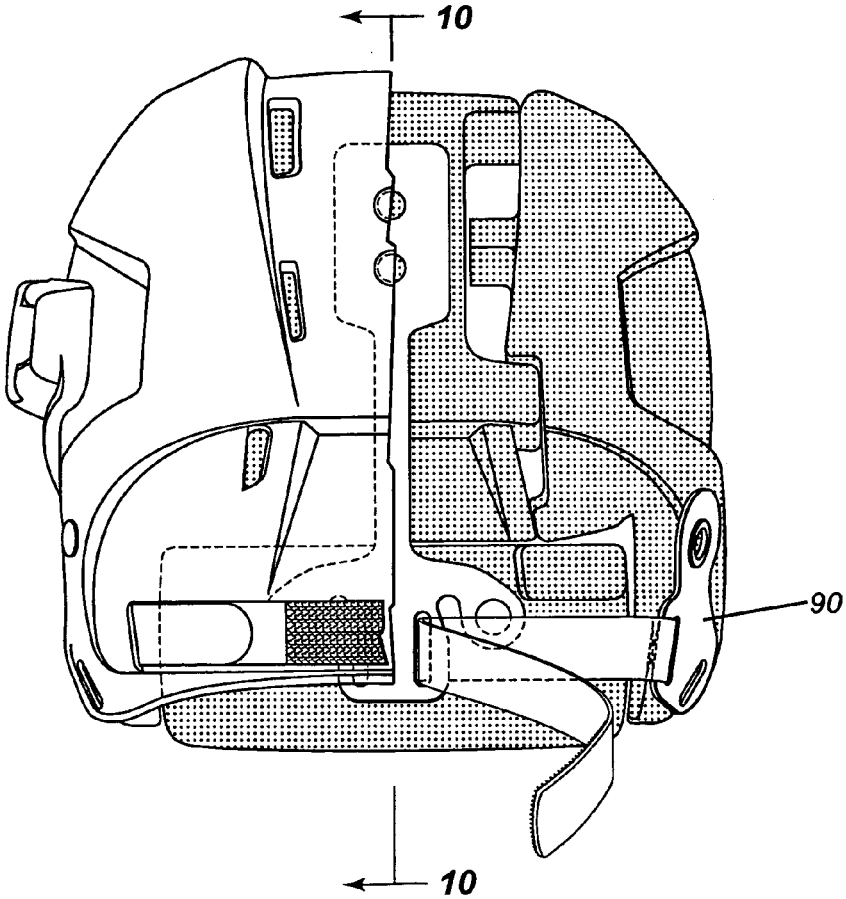
FIG. 9 is a rear elevational view of the hockey helmet of FIG. 3 wherein a portion of the outer shell is cut-away.
Figure 10:
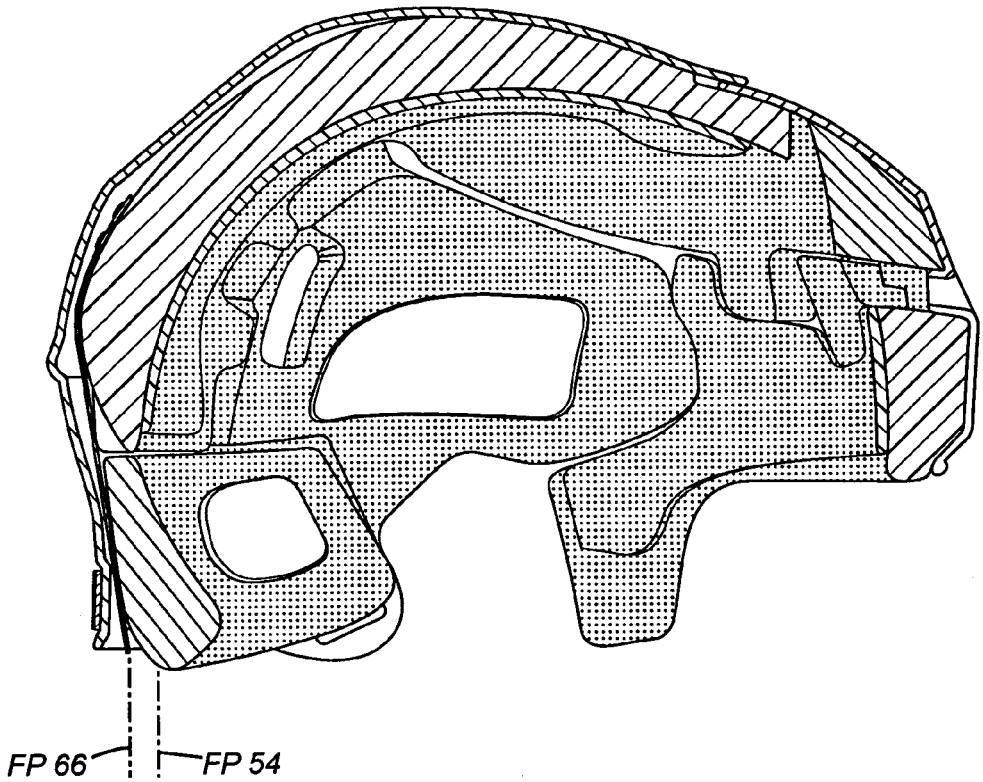
FIG. 10 is a cross-sectional view taken along lines 10-10.
Figure 11:
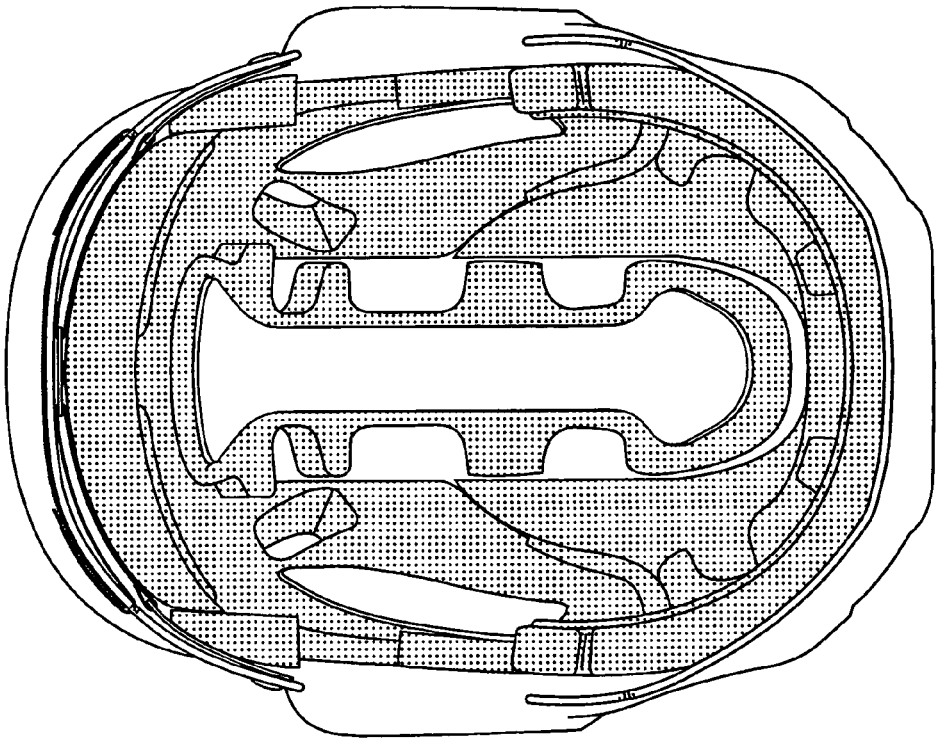
FIG. 11 is a bottom view of the hockey helmet of FIG. 3 with the occipital inner pad shown in a first position.

The central member 62 extends along the longitudinal axis of the helmet from an upper part 64, that is hingely connected to an inner surface of the rear portion 14 (e.g. to inner surface 96 of rear shell 18), to a lower part 66 that is attached to the occipital inner pad 54. The lower part 66 and the upper part 64 may be riveted to the occipital inner pad 54 and the rear shell 18 respectively. Other affixing means (e.g. glue, stitches, tacks, staples) can be used without departing from the spirit of the invention. The central member 62 may be a sheet-like member as illustrated in FIG. 7. The central member 62 is located between the rear shell 18 and the rear central and occipital inner pads 24, 54.

The lower part 66 is movable from a first position $FP^{66}$ (see FIGS. 10–11) to a second position $SP^{66}$ (see FIGS. 12–13) wherein, in the second position $SP^{66}$, the occipital inner pad 54 applies pressure upon the occipital region OR for urging the front portion 12 (front shell 16, front and top inner pads 22, 30 and front and top comfort liners 32, 38) towards the crown region CR. The lower part 66 comprises left and right passages 68, 70 positioned symmetrically about the longitudinal axis of the helmet 10 (see FIG. 6).

The helmet 10 also comprises left and right sheet-like elements 88, 90 affixed to the inner surface 96 of the rear shell 18. The left and right sheet-like elements 88, 90 comprise respective passages 92, 94 for receiving the first ends 76, 78 of respective left and right straps 72, 74. Each of the first ends 76, 78 may be passed through the respective passages 92, 94, be folded onto a portion of the strap and then be stitched to this portion (see first end 78 in FIG. 7). In that way, the first ends 76, 78 are retained in the helmet 10. Alternatively, the first ends 76, 78 may be directly stitched to the sheet-like elements 88, 90, which then would not comprise passages 92, 94.

Figure 5:
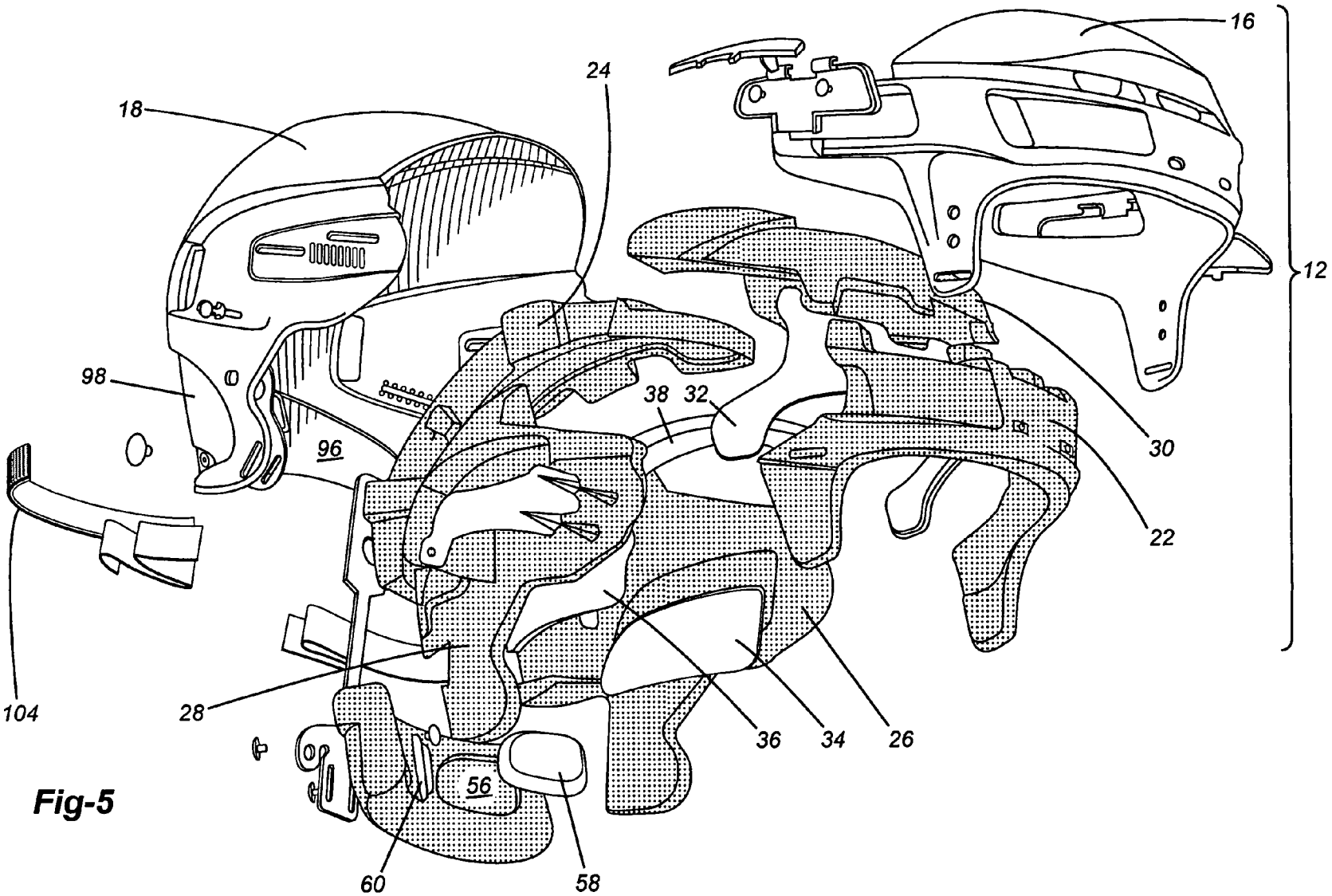
FIG. 5 is a front exploded perspective view of the hockey helmet of FIG. 3.
Figure 6:
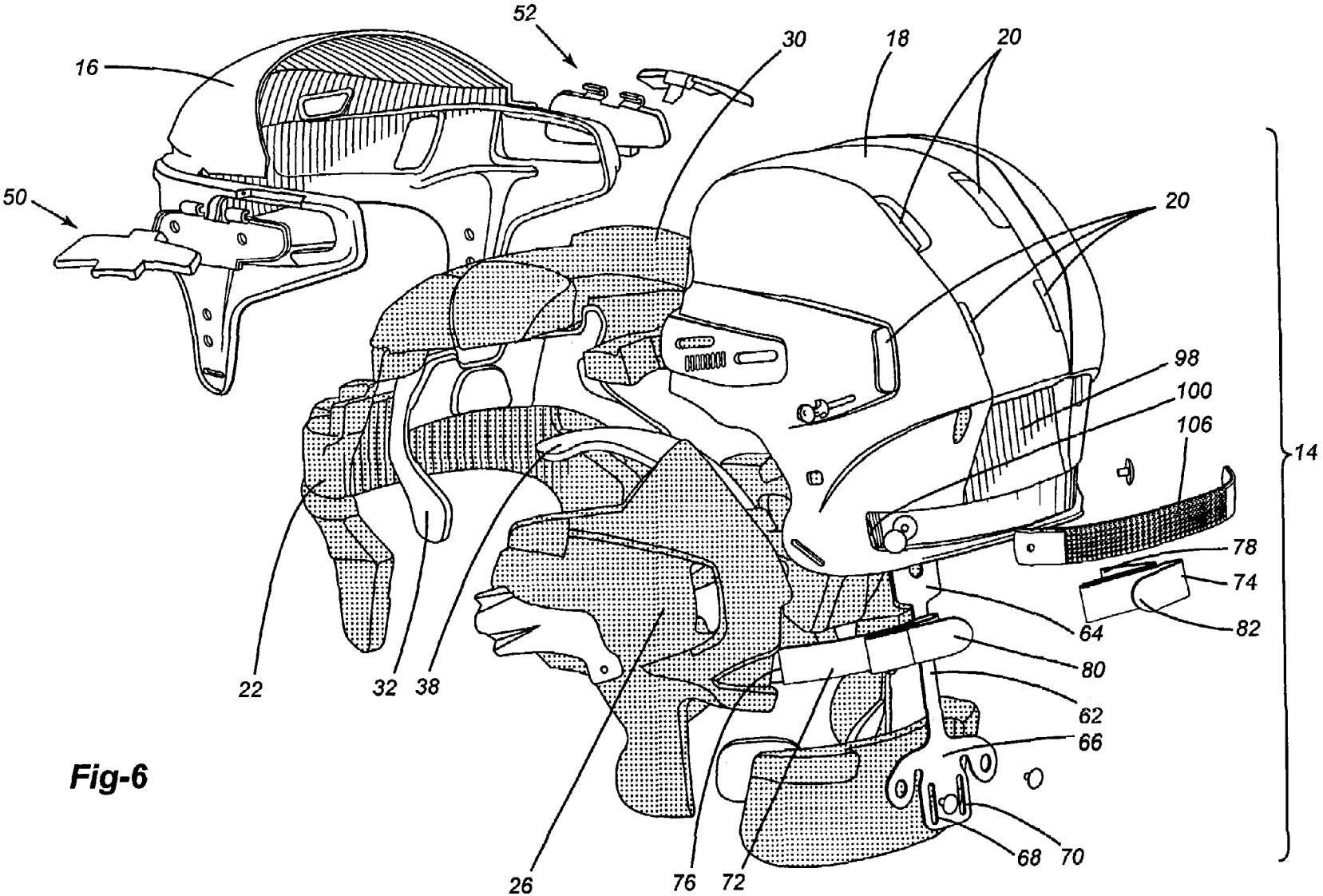
FIG. 6 a rear exploded perspective view of the hockey helmet of FIG. 3.

The rear shell 18 comprises left and right openings 100, 102 positioned symmetrically about the longitudinal axis of the helmet 10 for receiving the respective left and right straps 72, 74. As seen in FIGS. 5 and 6, the outer surface 98 of the rear shell 18 comprises a strip 104 affixed thereon between the left and right openings 100, 102, the strip 104 comprising a VELCRO loops section 106. It is understood that the strip 104 may comprise a VELCRO hooks section while the second ends 80, 82 may comprise respective VELCRO loops sections. The strip 104 may be affixed to the outer surface 98 by any suitable means, such as glue, stitches, tacks, staples or rivets.

The second ends 80, 82 of the straps 72, 74 pass through the respective left and right passages 98, 70 of the lower part 66 and the respective left and right openings 100, 102 of the rear shell 18. The second ends 80, 82 of the straps 72, 24 are therefore accessible to the wearer and the lower part 66 of the central member 62 can be moved from the first position $FP^{66}$ to the second position $SP^{66}$ when the wearer pulls the second ends 80, 82. Respective portions of the left and right straps 72, 74 overlap the strip 104 such that these portions are affixable to the strip 104 between first and second positions, wherein, in the second position, the occipital inner pad 54 applies pressure upon the occipital region OR for urging the front shell 16 towards the crown region CR.

The length of overlap between the left and right straps 72, 74 and the strip 104 controls the degree of pressure applied by the occipital inner pad 54; the more the wearer pulls on the left and right straps 72, 74, the more pressure is applied by the occipital inner pad 54. For example, the wearer can put the helmet 10 when the occipital inner pad 54 and lower part 66 are in the respective first positions $FP^{54}$, $FP^{66}$ (see FIGS. 10–11). If the wearer realizes that the fitting is not adequate, he/she then detaches overlapping portions of left and right straps 72, 74 from the strip 104 and, as illustrated in FIGS. 12–13, pulls second ends 80, 82 in order to move the occipital inner pad 54 and lower part 66 to the respective second positions $SP^{54}$, $SP^{66}$ (note that the wearer does not necessarily remove the helmet during this adjustment). As indicated previously, pressure applied by the occipital inner pad 54 upon the occipital region OR urges the front portion of the helmet towards the crown region CR. Moreover, the pressure applied upon the occipital region OC of the head is greater in the second position $SP^{54}$ than the one applied in the first position $FP^{54}$.

Figure 14:
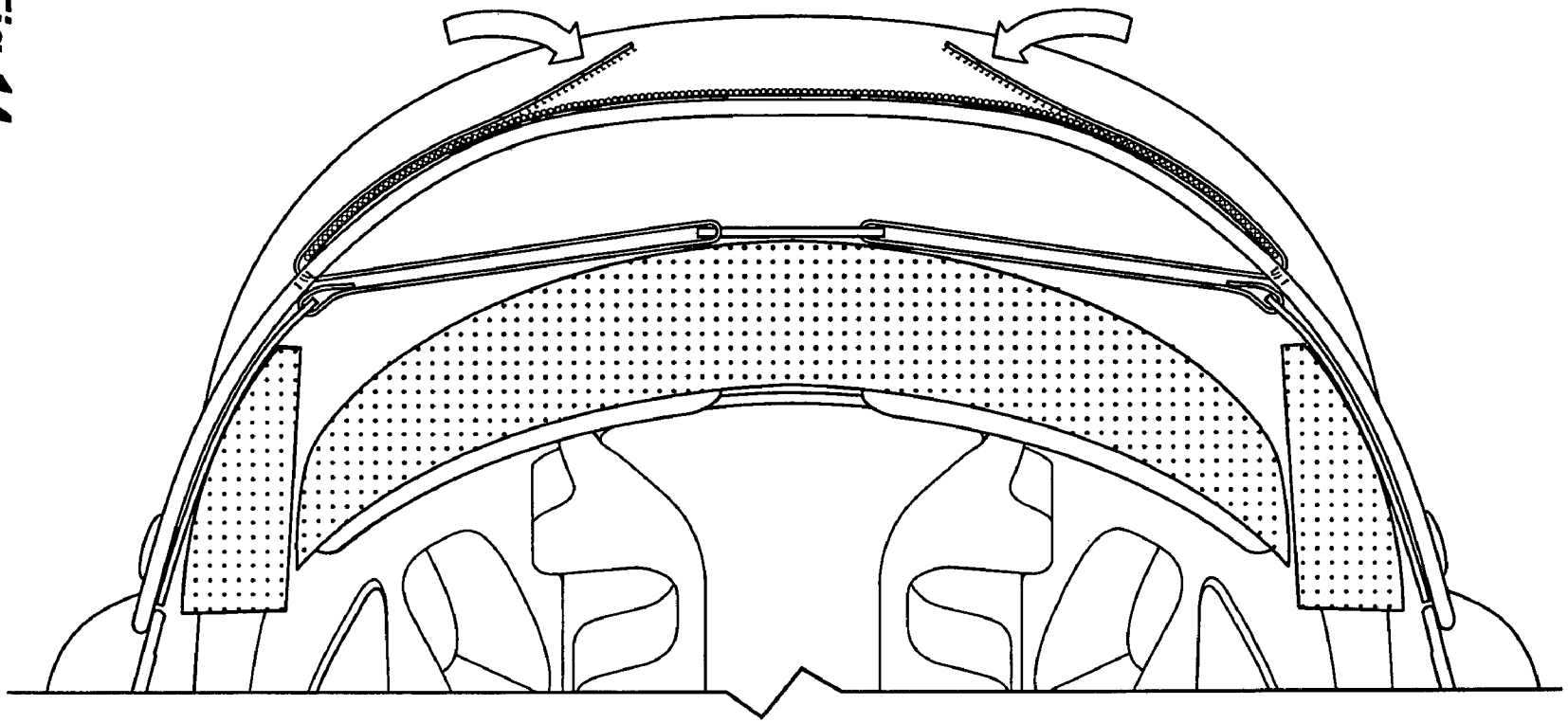
FIG. 14 is an enlarged partial bottom view of the hockey helmet with the occipital inner pad shown in the second position.

When the wearer obtains the adequate fitting, he/she then folds the second ends 80, 82 on the strip 104 in order to affix left and right straps 72, 74 to the strip 104 (see FIG. 14). In that way, the occipital inner pad 54 remains in the selected position wherein the occipital inner pad 54 applies the appropriate pressure. If the amount of pressure is too high, the wearer can simply detach the left and right straps 72, 74 from the strip 104, reduce the length of overlap between the left and right straps 72, 74 and the strip 104, and then fold again the second ends 80, 82 on the strip 104 in order to affix left and right straps 72, 74 to the strip 104.

The above description of the embodiments should not be interpreted in a limiting manner since other variations, modifications and refinements are possible within the spirit and scope of the present invention. The scope of the invention is defined in the appended claims and their equivalents.

What is claimed is:

1. A hockey helmet for receiving a head of a wearer, the head having a crown region, left and right side regions, a back region and an occipital region, said helmet comprising:

(a) a front portion facing the crown region of the head;

(b) a rear portion facing the left and right side regions, the back region and the occipital region of the head;

(c) an occipital inner pad located between said rear portion of said helment and the occipital region of the head; and (d) an actuator comprising a central member extending along a longitudinal axis of said helmet from an upper part that is hingedly connected to an inner surface of said rear portion of said helmet to a lower part that is attached to said occipital inner pad, said lower part of said central member being movable from a first position to a second position wherein, in said second position, said occipital inner pad applies pressure upon the occipital region of the head for urging said front portion towards the crown region of the head.

2. A hockey helmet as defined in claim 1, further comprising left and right sheet-like elements affixed to said inner surface of said rear portion of said helmet, and wherein said lower part of said central member comprises left and right passages positioned symmetrically about the longitudinal axis of said helmet and wherein said actuator comprises left and right straps passing through said left and right passages of said lower part respectively.

3. A hockey helmet as defined in claim 2, wherein each left and right sheet-like element comprises a passage, each of said left and right straps comprises first and second ends, each first end being received in each passage of said left and right elements, each second end being accessible to the wearer such that said lower part of said central member is movable from said first position to said second position when the wearer pulls each second end of said left end right straps.

4. A hockey helmet as defined in claim 3, wherein each second end of said left and right straps comprises a VELCRO hooks section or a VELCRO loops section.

5. A hockey helmet as defined in claim 4, wherein said front portion and said rear portions comprise respective front and rear shells, said front shell comprising an inner surface and said rear shell comprising outer and inner surfaces, said inner surface of said rear shell corresponding to said inner surface of said rear portion.

6. A hockey helmet as defined in claim 5, wherein said rear shell comprises left and right openings positioned symmetrically about the longitudinal axis of said helmet for receiving respective left and right straps such that each second end of said left and right straps is accessible to the wearer.

7. A hockey helmet as defined in claim 6, wherein said outer surface of said rear shell comprises a strip affixed thereon between said left and right openings of said rear shell, said strip comprising a VELCRO loops section or a VELCRO hooks section.

8. A hockey helmet as defined in claim 7, wherein each end of said left and right straps overlaps said strip such that each end is affixable to said strip between first and second positions, wherein, in said second position, said occipital inner pad applies pressure upon the occipital region of the head for urging said front portion towards the crown region of the head.

9. A hockey helmet as defined in claim 8, wherein said upper part of said central member is affixed to said inner surface of said rear shell.

10. A hockey helmet as defined in claim 8, wherein said lower part of said central member is riveted to said occipital inner pad.

11. A hockey helmet as defined in claim 8, wherein said left and right sheet-like elements are affixed to said inner surface of said rear shell.

12. A hockey helmet as defined in claim 8, wherein said occipital inner pad is made of expanded polypropylene (EPP) or expanded polyethylene (EPE).

13. A hockey helmet as defined in claim 12, wherein said occipital inner pad further comprises an occipital comfort liner affixed to an inner surface of said occipital inner pad.

14. A hockey helmet as defined in claim 13, wherein said occipital comfort liner comprises left and right occipital comfort liners positioned symmetrically about the longitudinal axis of said helmet.

15. A hockey helmet as defined in claim 14, wherein said left and right occipital comfort liners are made of polyvinyl chloride (PVC).

16. A hockey helmet as defined in claim 15, further comprising a front inner pad and a top inner pad affixed on said inner surface of said front shell.

17. A hockey helmet as defined in claim 16, further comprising a rear central inner pad and left and right side inner pads affixed on said inner surface of said rear shell.

18. A hockey helmet as defined in claim 17, further comprising a front comfort liner affixed on an inner surface of said front inner pad and a top comfort liner affixed on an inner surface of said top inner pad.

19. A hockey helmet as defined in claim 18, further comprising left and right side comfort liners affixed on an inner surface of respective said left and right inner pads.

20. A hockey helmet as defined in claim 19, wherein said front shell is movable relative to said rear shell for allowing size adjustment of said helmet.

21. A hockey helmet as defined in claim 1, wherein said actuator comprises a strap having a first end in said helmet and a second end accessible to the wearer, said strap cooperating with said central member such that said occipital inner pad moves to said second position when the wearer pulls said second end of said strap.

22. A hockey helmet for receiving a head of a wearer, the head having a crown region, left and right side regions, a back region and an occipital region, said helmet comprising:

(a) a front shell facing the crown region of the head;

(b) a rear shell facing the left and right side regions, the back region and the occipital region of the head, said rear shell comprising outer and inner surfaces and left and right openings positioned symmetrically about a longitudinal axis of said helmet;

(c) a rear inner pad facing the back and left and right side regions of the head, said rear inner pad being affixed to said inner surface of said rear shell;

(d) an occipital inner pad located between said rear shell and the occipital region of the head;

(e) a central member extending along the longitudinal axis of said helmet, said central member comprising an upper part that is hingedly connected to said inner surface of said rear shell and a lower part that is attached to said occipital inner pad, said lower part comprising left and right passages positioned symmetrically about the longitudinal axis of said helmet; and (f) left and right straps passing through said respective left and right passages of said lower part and said respective left and right openings of said rear shell, each strap comprising a first end and a second end, each first end being retained in said helmet, each second end being accessible to the wearer such that, when the wearer pulls each second end of said left and right straps, said lower part of said central member is movable from a first position to a second position wherein, in said second position, said occipital inner pad applies pressure upon the occipital region of the head for urging said front shell towards the crown region of the head.

23. A hockey helmet as defined in claim 22, further comprising left and right sheet-like elements affixed to said inner surface of said rear shell.

24. A hockey helmet as defined in claim 23, wherein each said left and right sheet-like elements comprises a passage for receiving said first end of said respective left and right straps.

25. A hockey helmet as defined in claim 24, wherein each second end of said left and right straps comprises a VELCRO hooks section or a VELCRO loops section.

26. A hockey helmet as defined in claim 25, wherein said outer surface of said rear shell comprises a strip affixed thereon between said left and right openings of said rear shell, said strip comprising a VELCRO loops section or a VELCRO hooks section.

27. A hockey helmet as defined in claim 26, wherein each end of said left and right straps overlaps said strip such that each end is affixable to said strip between first and second positions, wherein, in said second position, said occipital inner pad applies pressure upon the occipital region of the head for urging said front portion towards the crown region of the head.

28. A hockey helmet as defined in claim 27, wherein said lower part of said central member is riveted to said occipital inner pad.

29. A hockey helmet as defined in claim 27, wherein said occipital inner pad is made of expanded polypropylene (EPP) or expended polyethylene (EPE).

30. A hockey helmet as defined in claim 26, wherein said occipital inner pad further comprises an occipital comfort liner affixed to an inner surface of said occipital inner pad.

31. A hockey helmet as defined in claim 30, wherein said occipital comfort liner comprises left and right occipital comfort liners positioned symmetrically about the longitudinal axis of said helmet.

32. A hockey helmet as defined in claim 31, wherein said left and right occipital comfort liners are made of polyvinyl chloride (PVC).

33. A hockey helmet as defined in claim 32, further comprising a front inner pad and a top inner pad affixed on said inner surface of said front shell.

34. A hockey helmet as defined in claim 33, further comprising a rear central inner pad and left and right side inner pads affixed on said inner surface of said rear shell.

35. A hockey helmet as defined in claim 34, further comprising a front comfort liner affixed on an inner surface of said front inner pad and a top comfort liner affixed on an inner surface of said top inner pad.

36. A hockey helmet as defined in claim 35, further comprising left and right side comfort liners affixed on an inner surface of respective said left and right inner pads.

37. A hockey helmet as defined in claim 22, wherein said front shell is movable relative to said rear shell for allowing size adjustment of said helmet.

38. A hockey helmet for receiving a head of a wearer, the head having a crown region, left and right side regions, a back region and an occipital region, said helmet comprising:

(a) a front shell facing the crown region of the head;

(b) a rear shell facing the left and right side regions, the back region and the occipital region of the head, said rear shell comprising outer and inner surfaces and left and right openings positioned symmetrically about a longitudinal axis of said helmet;

(c) a rear inner pad facing the back and left and right side regions of the head, said rear inner pad being affixed to said inner surface of said rear shell;

(d) an occipital inner pad located between said rear shell and the occipital region of the head;

(e) a central member extending along the longitudinal axis of said helmet, said central member comprising an upper part that is hingely connected to said inner surface of said rear shell and a lower part that is attached to said occipital inner pad, said lower part comprising left and right passages positioned symmetrically about the longitudinal axis of said helmet; and (f) left and right straps passing through said respective left and right passages of said lower part and said respective left and right openings of said rear shell, each strap comprising a first end and a second end, each first end being retained in said helmet, each second end being accessible to the wearer such that, when the wearer pulls each second end of said left and right straps, said lower part of said central member is movable from a first position to a second position wherein, in said first position, said occipital inner pad applies a first pressure upon the occipital region of the head, and in said second position, said occipital inner pad applies a second pressure upon the occipital region of the head, the second pressure being greater than the first pressure.

* * * * *

UNITED STATES PATENT AND TRADEMARK OFFICE

CERTIFICATE OF CORRECTION

PATENT NO. : 6,968,575 B2
DATED : November 29, 2005
INVENTOR(S) : Jacques Durocher It is certified that error appears in the above-identified patent and that said Letters Patent is hereby corrected as shown below:

Column 7,
Line 50, “helment” should read -- helmet --.

Column 8,
Line 10, “end” should read -- and -- (second occurrence).

Column 10,
Line 56, “hingely” should read -- hingedly --.

Signed and Sealed this

Thirty-first Day of January, 2006

JON W. DUDAS
*Director of the United States Patent and Trademark Office*